US005407777A

United States Patent [19]

Shimada et al.

[11] Patent Number: 5,407,777

[45] Date of Patent: Apr. 18, 1995

[54] DIAZO-TYPE RECORDING MATERIAL COMPRISING A 1-PHENYL-3-PYRAZOLIDONE(PHENIDONE) AS AN ANTI-OXIDANT

[75] Inventors: Hirokazu Shimada; Akihiro Shimomura, both of Shizuoka, Japan

[73] Assignee: Fuji Photo Film Co., Ltd., Kanagawa, Japan

[21] Appl. No.: 977,639

[22] Filed: Nov. 17, 1992

[30] Foreign Application Priority Data

Nov. 20, 1991 [JP] Japan ..... 3-331245

[51] Int. Cl.[6] ..... G03C 1/72; G03C 1/61; G03C 1/58

[52] U.S. Cl. ..... 430/138; 430/157; 430/173; 430/177; 430/179; 430/182

[58] Field of Search ..... 430/179, 138, 177, 157, 430/173, 182

[56] References Cited

U.S. PATENT DOCUMENTS

| | | | |
|---|---|---|---|
| 3,676,138 | 7/1972 | Poot et al. | 430/179 |
| 3,725,066 | 4/1973 | Nihyakumen | 430/182 |
| 3,985,562 | 10/1976 | Mertens et al. | 430/179 |
| 4,370,401 | 1/1983 | Winslow et al. | 430/179 |
| 4,419,432 | 12/1983 | Pilliteri | 430/179 |
| 4,760,048 | 7/1988 | Kurihara et al. | 430/171 |
| 4,980,260 | 12/1990 | Shinozaki et al. | 430/171 |

FOREIGN PATENT DOCUMENTS

| | | | |
|---|---|---|---|
| 138027 | 10/1979 | Germany | 430/182 |
| 655007 | 7/1951 | United Kingdom | 430/182 |
| 1324696 | 7/1973 | United Kingdom . | |

OTHER PUBLICATIONS

Wiley, Richard and Wiley Paul, "Pyrazolones, Pyrazolidones, and Derivatives", pp. 3–12 1964.

*Primary Examiner*—Charles L. Bowers, Jr.
*Assistant Examiner*—John S. Chu
*Attorney, Agent, or Firm*—Sughrue, Mion, Zinn, Macpeak & Seas

[57] ABSTRACT

A diazo-type recording material comprising a support having thereon a recording layer comprising a photosensitive diazo compound enclosed in microcapsules, a coupling component which reacts with said diazo compound by heating at a basic pH to develop a color, and a 1-phenyl-3-pyrazolidone compound represented by the formula:

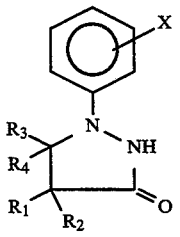

wherein the substituents X, and $R_1$–$R_4$ are defined in the specification.

11 Claims, No Drawings

DIAZO-TYPE RECORDING MATERIAL COMPRISING A 1-PHENYL-3-PYRAZOLIDONE(PHENIDONE) AS AN ANTI-OXIDANT

FIELD OF THE INVENTION

The present invention relates to a recording material using a photosensitive diazo compound and more particularly relates to a diazo-type recording material, of which the base texture has improved preservation stability.

BACKGROUND OF THE INVENTION

Reproducing materials advantageously utilizing the photosensitivity of diazo compound are widely in use due to their low cost, and are known by the following three major types.

The first type, known as the wet developing type, is formed by a photosensitive layer comprising a diazo compound and a coupling component as the main constituents on the support. After this type of reproducing materials is laid over the original to be reproduced and exposed to light, it is developed with an alkaline solution.

The second type, known as the dry developing type, is developed with ammonia gas, rather than the alkaline solution used by the wet developing type.

The third type known as the heat-developing type has several variations. These variations include the type which contains an ammonia gas generating agent like urea, which upon heating, generates ammonia gas in the photosensitive layer; the type which contains an alkaline salt of compounds such as trichloroacetic acid, which lose their acidic characteristics upon heating, in the photosensitive layer, or the type in which thermal fusion activates a diazo compound and a coupling component, and which uses higher fatty amide as coloring aid.

The wet type of recording materials have a number of disadvantages, including that it is impossible to make additional entries soon after copying because the recording material is still wet, and that copied images cannot tolerate long storage. In addition, there are difficulties in maintenance and control, such as replenishing and disposing of the developing agent due to its liquid form, and the large size of the equipment.

The dry type materials also result in problems with replenishing the liquid developer, similar to the wet type. In addition, this type has the disadvantage of requiring an ammonia gas absorbing device in order to prevent leakage of the generated gas to the outside, this in turn requires large equipment and creates a strong odor of ammonia immediately after reproducing.

On the other hand, the heat-developing type, in contrast to the wet type and the dry type, provides an advantage in maintenance by eliminating the use of a developing liquid, although it has the disadvantages of possible underdevelopment and variable color tones due to the required high developing temperature of 150° C. to 220° C. with a temperature control tolerance of ±10° C., which requires costly equipment to ensure the reproduction of high-quality images. Furthermore, in order to withstand such a high developing temperature, the diazo compound used in this type must have high heat resistance, which is often a disadvantage in obtaining the high density of recorded images.

Therefore, various attempts have been made to achieve low temperature development between 90° C. and 130° C., but these attempts resulting in shorter shelf lives in the recording materials. Thus, the heat-developing type of reproducing materials have not yet become a widely used type of diazo-type reproducing system, although it is well known that heat-developing type has more advantageous maintenance properties when compared to the wet type and the dry type.

On the other hand, user's needs are continuously being diversified. For example, the user may need to not only obtain colored images on a white base, but also need to choose hues for the base texture and colored images to match depending on the uses. This is because it is necessary to draw the user's attention to the reproduced items when the recording material is used for drawings or posters, however, the existing recording materials are not capable of meeting such needs.

In order to obtain the desired color density through heating a layer comprising a diazo compound, a coupling component and a coloring aid provided on the support, it is necessary to form the dyes by instant solving, dispersing and reacting the respective components through heating.

In this case, however, if a recording material was to be designed such that it is possible to develop colors at low temperatures and produce high density images, the coloring reaction would gradually proceed at room temperature during storage before the material is used. This would cause the base texture to be spoiled with colors, instead of keeping the base texture clean white.

In the present invention, these above-mentioned problems, which look incompatible at a glance, have been overcome by enclosing the diazo compound component in microcapsules on the reproducing material in a photosensitive layer comprising a diazo compound, a coupling component and a coloring aid provided on the support, which can be developed by heating (refer to U.S. Pat. No. 4,529,681).

However, even in this case, if images of considerably high density are desired, the period of time in which the recording material can be maintained before it is used for this purpose is insufficient.

SUMMARY OF THE INVENTION

An object of the present invention is to provide a diazo-type recording material which can give high density images while providing a base texture which inhibits the occurrence of staining and exhibits improved preservability. Other objects of the present invention are apparent from the following detailed description and examples.

The above-described objects of the present invention are accomplished through the use of a diazo-type recording material comprising a support having thereon a recording layer comprising a photosensitive diazo compound enclosed in microcapsules, a coupling component which reacts with said diazo compound by heating at a basic pH to develop a color, and a 1-phenyl-3-pyrazolidone compound represented by the following formula (I):

(I)

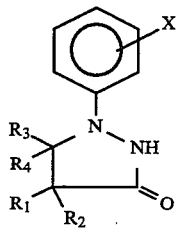

wherein X represents a hydrogen atom, a chlorine atom, a bromine atom, a fluorine atom, a methoxy group, an ethoxy group, a phenoxy group or an alkyl group which has from 1 to 6 carbon atoms; and $R_1$, $R_2$, $R_3$ and $R_4$ represent a hydrogen atom, an alkyl group which has from 1 to 6 carbon atoms, a phenyl group, a hydroxymethyl group, a hydroxyethyl group or a benzyl group.

DETAILED DESCRIPTION OF THE INVENTION

Diazo compounds which can be used in the present invention may be suitably selected from known diazo compounds which are subjected to coupling reaction with coupling components to develop colors as well as photo decomposition, that is they are also photodecomposable compounds, such as diazonium salts, diazosulfonates and diazoamino compounds. Of these diazo compounds in view of both photosensitivity and density of the recorded images obtained herein, preferred are diazonium salts represented by general formula: $ArN_2^+X^-$, wherein Ar represents a substituted or unsubstituted aromatic group; $N_2^+$ represents a diazonium group; and $X^-$ represents an acid anion.

Specific examples of the diazonium salts include 4-diazo-1-dimethylaminobenzene, 4-diazo-1-diethylaminobenzene, 4-diazo-1-dipropylaminobenzene, 4-diazo-1-methylbenzylaminobenzene, 4-diazo-1-dibenzylaminobenzene, 4-diazo-1-ethylhydroxyethylaminobenzene, 4-diazo-1-diethylamino-3-methoxybenzene, 4-diazo-1-dimethylamino-2-methylbenzene, 4-diazo-1-benzoylamino-2,5-diethoxybenzene, 4-diazo-1-morpholinobenzene, 4-diazo-1-morpholino-2,5-diethoxybenzene, 4-diazo-1-morpholino-2,5-dibutoxybenzene, 4-diazo-1-tolylmercapto-2,5-diethoxybenzene, and 4-diazo-1-(4-methoxybanzoyl)amino-2,5-diethoxybenzene.

Specific examples of the acids which are used in forming the diazonium salts described above include $C_nF_{2n-1}COOH$ wherein n represents an integer of 1 to 9, $C_mF_{2m+1}SO_3H$ wherein m represents an integer of 1 to 9, boron tetrafluoride, tetraphenylboron, hexafluorophosphoric acid, aromatic carboxylic acid and metal halide such as zinc chloride and stannic chloride.

The coupling components which can be used in the present invention are compounds which undergo coupling reaction with diazo compounds at a basic pH to develop colors. Specific examples of such coupling components include resorcin, phloroglucin, sodium 2,3-dihydroxynaphthalene-6-sulfonate, 1-hydroxy-2-naphthoic morpholinopropylamide, 1,5-dihydroxynaphthalene, 2,3-dihydroxynaphthalene, 2,3-dihydroxy-6-sulfanilnaphthalene, 2-hydroxy-3-naphthoic morpholinopropylamide, 2-hydroxy-3-naphthoic anilide, 2-hydroxy-3-naphthoic-2'-methylanilide, 2-hydroxy-3-naphthoic ethanolamide, 2-hydroxy-3-naphthoic octylamide, 2-hydroxy-3-naphthoic-N-dodecyloxy-propylamide, 2-hydroxy-3-naphthoic tetradecylamide, acetanilide, acetoacetanilide, benzoylacetanilide, 1-phenyl-3-methyl-5-pyrazolone, 1-(2',4',6'-trichlorophenyl)-3-benzamido-5-pyrazolone, 1-(2',4',6'-trichlorophenyl)-3-anilino-5-pyrazolone and 1-phenyl-3-phenyl-acetamido-5-pyrazolone. These coupling components may be used in combination of two or more to obtain colored images with a particular tone.

In the present invention basic substances which act as coloring aids may be selectively used as needed to make the system alkaline during heat-development in order to facilitate the coupling reaction by creating basic pH. The term "coloring aid" as used herein means both a basic substance and a melting point-lowering agent. Such basic additives include basic compounds which are slightly soluble or insoluble in water, or compounds which are capable of creating alkali during heating may be used. Specific examples of these basic substances include nitrogen-containing compounds such as inorganic or organic ammonium salts, organic amines, amides, ureas and thioureas and derivatives thereof, thiazoles, pyrroles, pyrimidines, piperazines, guanidines, indoles, imidazoles, imidazolines, triazoles, morpholines, piperidines, amidines, formamidines and pyridines. These basic substanes may be used in combination of two or more.

In order to conduct rapid and complete heat-development with the use of lower energy, additional compounds may be incorporated to the photosensitive layer of the present invention. Examples of such additional compounds include phenol derivatives, naphthol derivatives, alkoxy-substituted benzenes, alkoxy-subsitited naphthalnes, hydroxy compounds, amide compounds and sulfonamides. These compounds permit lowering the melting point of a coupling component or a basic substance or improving heat transmission through the wall of microcapsules and as a result act as coloring aid, thereby producing colored images of high density.

The coloring aids of the present invention may also include thermally fusible substances. The thermally fusible substances are those which are solids at room temperature and melt by heating with a melting point of 50° to 150° C., and which are capable of dissolving diazo compounds, coupling components or basic substances. Specific examples of the thermally fusible substances described above include fatty amides, N-substituted fatty amides, ketone compounds, urea compounds and esters.

Specific examples of the 1-phenyl-3-pyrazolidone compounds represented by the foregoing formula (I) which can be used in the present invention include those represented by the following formula (II), (III) or (IV). Of them, particularly preferred are the compounds represented by formula (IV).

(II)

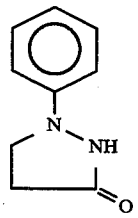

-continued (III)

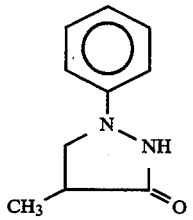

(IV)

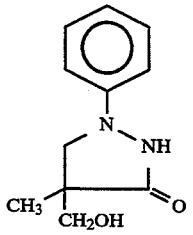

The incorporation of at least one of the 1-phenyl-3-pyrazolidone compounds described above into a recording layer according to the present invention can prevent staining of the base texture before recording.

The 1-phenyl-3-pyrazolidone compound of the present invention, described above, may be preferably used in an amount of from 0.001 to 0.01 g/m$^2$. When used in an amount less than 0.001 g/m$^2$, these compounds have no effect on preventing staining of the base texture, and when used in an amount greater than 0.01 g/m$^2$, these compounds result in undesirably reduced thermal sensitivity. The 1-phenyl-3-pyrazolidone compound described above according to the present invention may be incorporated anywhere into the wall of microcapsules, for example into either the inside or the outside thereof, or in a combination of the two or more thereof. Particularly, it is preferred to incorporate the 1-phenyl-3-pyrazolidone compound in the same place as where the above-described basic substance is added.

According to the present invention, a coupling component and a coloring aid may be preferably used in an amount of from 0.1 to 10 parts, preferably 0.5 to 3 parts by weight and from 0.1 to 20 parts, preferably 2 to 10 parts by weight, respectively, on the basis of 1 part by weight of the diazo compound used herein. The diazo compound may be preferably used in an amount of from 0.05 to 5.0 g/m$^2$, preferably 0.1 to 5.0 g/m$^2$.

The microcapsules of the present invention may be produced by emulsifying a core substance and then forming a wall of polymeric material around the resulting oil droplets. The reactants which are used to form the polymeric material may be incorporated into the inside and/or outside of the oil droplets. Specific examples of the polymeric materials include polyurethanes, polyureas, polyamides, polyesters, polycarbonates, urea-formaldehyde resins and melamin resins. The polymeric substances may be used in combinations of two or more thereof. Of these polymeric materials, polyurethanes, polyureas, polyamides, polyesters and polycarbonates are preferred, and more preferred are polyurethanes and polyureas. The polymeric materials are preferably those which do not melt at recording temperature, and have melting point of 150° C. or more. The microcapsules of the present invention may be preferably produced from an emulsion containing the component intended to be the microcapsules in an amount of 0.2% by weight or more.

The microcapsules used in the present invention may be preferably those which are substantially free from solvent, such that they are obtained by dissolving a diazo compound, a coupling component and the monomer intended to form the wall of the microcapsules in a nonaqueous solvent with a low boiling point, followed by a polymerizing step during which the solvent is distilled off. When the monomer is polymerized as described above to produce the polymer which forms the wall of the microcapsules, the monomer may be used in an amount such that the resulting microcapsules have an average particle diameter of from 0.3 to 12 μm and also a wall thickness of from 0.01 to 0.3 μm. In these ranges, the diazo compound can be securely enclosed in the microcapsules. As a result, the diazo compound is strictly prevented from coming into contact with any of the coupling component at room temperature. This is different from the situation in the previous systems.

The respective components which can be used in the recording material of the present invention may be incorporated therein in the form of dispersion. A coupling component, which are not be incorporated into the microcapsules as described above, a basic substance, a coloring aid and others may be preferably incorporated in the material after they are dispersed in the solid state with a water-soluble polymer using a sand mill or the like. The preferred water-soluble polymers used herein are those which are being used to prepare the microcapsules (refer to, for example, JP-A-59-190886). In this case, a coupling component and a coloring aid may be used in an amount of from 5 to 40% by weight on the basis of a water-soluble polymer solution. The size of the resulting particles so dispersed may be preferably 10 μm or less.

Alternatively, as the aforementioned components, a coupling component, a basic substance, a coloring aid and others may also be used in the form of emulsion or dispersion obtained by way of dissolving them in an organic solvent (such as tricresylphosphate or other esters), which is slightly soluble or insoluble in water, then mixing the resulting solution with an aqueous phase which contains a surface-active agent (such as sodium alkylbenzenesulfonate) and a water-soluble polymer (such as polyvinyl alcohol) as a protective colloid and so emulsifying or dispersing the mixture thus obtained herein. In this case, a transparent recording material can be obtained therefrom.

The coating composition of the present invention may be applied onto a photosensitive layer by various known coating methods. Examples of the coating methods which can be used herein include bar coating, blade coating, air knife coating, gravure coating, doctor coating, slide coating, roll coating, spray coating, dip coating, curtain coating and other coating methods which are described in "Coating Engineering" by Yuji Harazaki (published by Asakura Shoten in 1973) page 253. According to the present invention, the photosensitive layer used herein may be formed by way of regulating the coating amount in the range of from 2.5 to 30 g/m$^2$ on a dry solid content basis after coating.

In the recording material of the present invention, various components such as a diazo compound, a coupling component and a basic substance may be present in the same layer as described above, or may be differently present in various layers, for example so as to form a laminate structure. Furthermore, the photosensitive layer of the present invention may be applied onto a support after providing an intermediate layer thereon, as described in JP-A-61-54980(the term "JP-A" as used herein means an "unexamined published Japanese patent application"), or a protective layer may also be provided on the photosensitive layer.

In forming images using the recording material obtained according to the present invention, the material laid over the paper to be reproduced may be imagewise exposed to light in order to decompose the diazo compound present in the areas struck by the light and then the material as a whole may be heated to allow the remaining diazo compound and coupling component present in the areas not struck by the light to react, thus producing colored images. Alternatively, after imagewise heat-recording using a heat pen or a thermal head, the entire surface of the recording material may be exposed to light to decompose the diazo compound remaining in the unrecorded, and thus uncolored areas thereof, thus resulting in fixing.

Imagewise photoexposure which allows an original to be reproduced may be performed by simply photoexposing the recording material of the present invention in close contact with, and laid over the origianl to be reproduced in the case of transparent paper. An exposure using other means, such as lasers, may also be used herein. Examples of light sources to which the present recording material can be exposed to produce images include various fluorescent lamps, a xenon lamp and a mercury lamp. In these cases, the emission spectrum of the light source should be nearly equal to the absorption spectrum of a diazo compound used herein.

Examples of the heating means used in heat-developing the entire surface of the recording material of the present invention include heaters, such as an infrared heater, a high frequency heater, a heat block and a heat roller.

As described above in detail, the diazo-type recording materials according to the present invention comprising a 1-phenyl-3-pyrazolidone compound can provide a base texture which has an improved ability to inhibit the occurrence of staining, as compared to the recording materials conventionally available, though the reason thereof is not necessarily clear.

The present invention will be explained in greater detail with reference to the following examples, but the present invention should not be construed as being limited thereto. The parts hereinafter are by weight unless otherwise indicated.

EXAMPLE 1

Preparation of Capsule Liquid

Added to 13 parts of ethyl acetate was 3 parts of diazonium salt represented by formula (V):

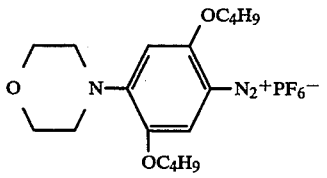

(V)

to form a solution. Subsequently added to the solution was 7 parts of 75% ethyl acetate solution of a 1:3 adduct of trimethylolpropane and xylylenediisocyanate (trade name: Takenate D110N; manufactured by Takeda Yakuhin Kogyo Co., Ltd.) represented by formula (VI):

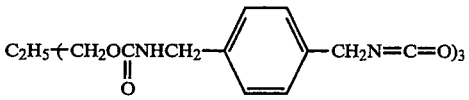

(VI)

with stirring to form a mixture. Then added to the mixture thus obtained containing the diazonium salt and isocyanate compound in the ethylacetate solution was an aqueous solution which was obtained by dissolving 3.5 parts of polyvinyl alcohol (trade name PVA 217E; manufactured by Kuraray Co., Ltd.) in 60 parts of water to form a composition which was then emulsified and dispersed, thus resulting in an emulsion having an average particle diameter of 1.0 μm. The resulting emulsion was mixed with 20 parts of water and then heated to 40° C. with stirring to allow the isocyanate to react over a period of 3 hours for forming a wall, thus producing microcapsules having an average particle diameter of 1 μm and containing the diazo compound as a core substance. The microencapsulation reaction described above was performed under reduced pressure ranging from 400 to 500 mmHg using a water-jet pump.

Preparation of Coupler Dispersion

Added to 100 parts of 5% by weight aqueous solution of polyvinyl alcohol were 5 parts of 2-hydroxy3-naphthanilide and 5 parts of triphenylguanidine to form a mixture which was dispersed over a period of 24 hours using a sand mill to obtain a dispersion having an average particle diameter of 3 μm.

Preparation of Coating Composition

Added to 8 parts of the capsule liquid containing the diazonium salt thus obtained were 25 parts of the dispersion containing the coupling component and triphenylguanidine 2 parts of 40% by weight calcium carbonate dispersion (trade name: Unibar 70; manufactured by Shiraishi Kogyo Co., Ltd.), 0.3 part of 1% aqueous solution of the compound represented by the foregoing formula (IV) and 0.5 part of water to form a coating composition.

Preparation of Recording Material

The resulting coating composition as described above was bar-coated on a smooth sheet of quality paper (76 g/2 m$^2$) in a coating amount of 5 g/m$^2$ on a dry basis using a coating bar and then dried over a period of 3 minutes at 50° C. to obtain a recording material.

Evaluation of Preservability

For the purpose of evaluating preservability (during storage) before use of the recording material thus obtained which is not yet exposed, the material was subjected to forced deterioration testing by being allowed to stand for a day under an atmosphere of 40° C., 90% RH (relative humidity) and 60° C., 30% RH, respectively, in darkness to determine the density of the base texture thereof using a Macbeth densitometer. A change in density was observed before and after testing. The results obtained herein are shown in Table 1. In addition, the values in density of recorded images observed herein were 1.25 before and after testing.

COMPARATIVE EXAMPLE 1

A recording material was prepared and the deterioration testing of the material thus obtained was conducted in the same manner as in Example 1 except for not using the compound represented by the foregoing formula (IV). The results obtained herein are also shown in Table 1.

TABLE 1

| Recording Material | Density of Base Texture: Before Deterioration Testing | After Deterioration Testing 40° C., 90% RH, for one day | After Deterioration Testing 60° C., 30% RH, for one day |
|---|---|---|---|
| Example 1 | 0.11 | 0.13 | 0.12 |
| Comparative Example 1 | 0.12 | 0.17 | 0.15 |

The results set forth in Table 1 give evidence of the effects of the present invention.

While the invention has been described in detail and with reference to specific embodiments thereof, it will be apparent to one skilled in the art that various changes and modifications can be made therein without departing from the spirit and scope thereof.

What is claimed is:

1. A diazo recording material comprising a support having thereon a recording layer comprising a photosensitive diazo compound enclosed in microcapsules, a coupling component which reacts with said diazo compound by heating at a basic pH to develop a color, and a 1-phenyl-3-pyrazolidone compound represented by formula (I):

(I)

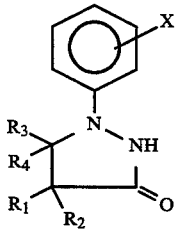

wherein X represents a hydrogen atom, a chlorine atom, a bromine atom, a fluorine atom, a methoxy group, an ethoxy group, a phenoxy group or an alkyl group which has from 1 to 6 carbon atoms; and $R_1$, $R_2$, $R_3$ and $R_4$ represent a hydrogen atom, an alkyl group which has from 1 to 6 carbon atoms, a phenyl group, a hydroxymethyl group, a hydroxyethyl group or a benzyl group.

2. The diazo recording material of claim 1, wherein the 1-phenyl-3-pyrazolidone of formula (I) is represented by one of the following formulas:

(II)

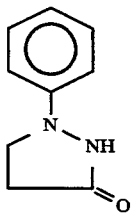

-continued (III)

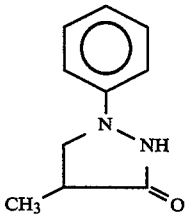

(IV)

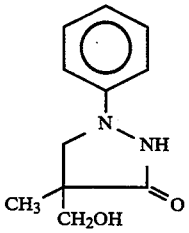

3. The diazo recording material of claim 1, wherein the diazo compound is a diazonium salt selected from the group consisting of 4-diazo-1-dimethylaminobenzene, 4-diazo-1-diethylaminobenzene, 4-diazo-1-dipropylaminobenzene, 4-diazo-1-methylbenzylaminobenzene, 4-diazo-1-dibenzylaminobenzene, 4-diazo-1-ethylhydroxyethyl-aminobenzene, 4-diazo-1-diethylamino-3-methoxybenzene, 4-diazo-1-dimethylamino-2-methylbenzene, 4-diazo-1-benzoylamino-2,5-diethoxybenzene, 4-diazo-1-morpholino-2,5-diethoxybenzene, 4-diazo-1-morpholinobenzene, 4-diazo-1-morpholino-2,5-dibutoxybenzene, 4-diazo-1-tolylmercapto-2,5-diethoxybenzene, and 4-diazo-1-(4-methoxybenzoyl)amino-2,5-diethoxybenzene.

4. The diazo recording material of claim 1, wherein the coupling compound is selected from the group consisting of resorcin, phloroglycin, sodium 2,3-dihydroxynaphthalene-6-sulfonate, 1-hydroxy-2-naphthoic morpholinopropylamide, 1,5-dihydroxynaphthalene, 2,3-dihydroxynaphthalene, 2,3-dihydroxy-6-sulfanilnaphthalene, 2-hydroxy-3-naphthoic morpholinopropylamide, 2-hydroxy-3-naphthoic anilide, 2-hydroxy-3-naphthoic-2'-methylanilide, 2-hydroxy-3-naphthoic ethanolamide, 2-hydroxy-3-naphthoic octylamide, 2-hydroxy-3-naphthoic-N-dodecyloxy-propylamide, 2-hydroxy-3-naphthoic tetradecylamide, acetanilide, acetoacetanilide, benzoylacetanilide, 1-phenyl-3-methyl-5-pyrazolone, 1-(2',4',6'-trichlorophenyl)-3-anilino-5-pyrazolone, and 1-phenyl-3-phenylacetamide-5-pyrazolone.

5. The diazo recording material of claim 1, wherein said recording material additionally contains a coloring aid which is selected from the group consisting of inorganic and organic ammonium salts, organic amines and amides, ureas and thioureas and derivatives thereof, thiazoles, pyrroles, pyrimidines, piperazines, guanidines, indoles, imidazoles, imidazolines, triazoles, morpholines, piperidines, amidines, formamidines, pyridines, phenol derivatives, naphthol derivatives, alkoxy-substituted benzenes, alkoxy-substituted naphthalenes, hydroxy compounds, amide compounds, sulfonamides, fatty amides, N-substituted fatty amides, ketone compounds, urea compounds and esters.

6. The diazo recording material of claim 1, wherein the amount of the diazo compound employed is 0.05 to 5.0 $g/m^2$.

7. The diazo recording material of claim 1, wherein the amount of the coupling component employed is 0.1 to 10 parts by weight to one part by weight of the diazo compound.

8. The diazo recording material of claim 1, wherein the amount of the 1-phenyl-3-pyrazolidone compound represented by formula (I) employed is 0.001 to 0.01 $g/m^2$.

9. The diazo recording material of claim 2, wherein the 1-phenyl-3-pyrazolidone compound of formula (I) is represented by formula (II).

10. The diazo recording material of claim 2, wherein the 1-phenyl-3-pyrazolidone compound of formula (I) is represented by formula (III).

11. The diazo recording material of claim 2, wherein the 1-phenyl-3-pyrazolidone compound of formula (I) is represented by formula (IV).

* * * * *